US005083079A

United States Patent [19]

Plants

[11] Patent Number: 5,083,079

[45] Date of Patent: Jan. 21, 1992

[54] CURRENT REGULATOR, THRESHOLD VOLTAGE GENERATOR

[75] Inventor: William C. Plants, Santa Clara, Calif.

[73] Assignee: Advanced Micro Devices, Inc., Sunnyvale, Calif.

[21] Appl. No.: 617,287

[22] Filed: Nov. 19, 1990

Related U.S. Application Data

[63] Continuation of Ser. No. 349,204, May 9, 1989, abandoned.

[51] Int. Cl.[5] ..... G05F 3/16

[52] U.S. Cl. ..... 323/313; 323/315; 307/296.8

[58] Field of Search ..... 307/296.1, 296.8; 323/313, 315

[56] References Cited

U.S. PATENT DOCUMENTS

| | | | |
|---|---|---|---|
| 4,450,367 | 5/1984 | Whatley | 323/315 |
| 4,461,991 | 7/1984 | Smith | 323/315 |
| 4,477,737 | 10/1984 | Ulmer et al. | 307/297 |
| 4,495,425 | 1/1985 | McKenzie | 323/315 |
| 4,612,497 | 9/1986 | Ulmer | 323/315 |
| 4,697,154 | 9/1987 | Kousaka et al. | 323/315 |
| 4,723,108 | 2/1988 | Murphy et al. | 323/315 |
| 4,769,589 | 9/1988 | Rosenthal | 323/313 |
| 4,808,909 | 2/1989 | Eddlemon | 323/313 |

FOREIGN PATENT DOCUMENTS 2081940A 8/1980 United Kingdom .

OTHER PUBLICATIONS

Patent Abstract of Japan, vol. 10, No. 116 (P-452) (2173), 30 Apr. 1986, & JP-A-60 245007 (Mitsubishi) 4 Dec. 1985.

"FET Threshold Voltage Generator", Research Disclosure, No. 281, Sep. 1987, New York, p. 572, J. K. Moriarty, Jr.

*Primary Examiner*—Jeffrey Sterrett

*Attorney, Agent, or Firm*—Townsend and Townsend

[57] ABSTRACT

A CMOS circuit which can act as a current regulator for a variety of general MOS circuits. The circuit has current-biasing network connected to the source electrode of a first transistor. The drain electrode of the first transistor is connected to an input terminal of a current mirror arrangement. The output terminal of the current mirror is connected to the drain electrode of a first diode-configured transistor. The source electrode of the first diode-configured transistor is connected to a second diode-configured transistor. By connecting output terminals at various nodes of the circuit, the current of a variety of MOS circuits may be regulated by the current-biasing network.

21 Claims, 3 Drawing Sheets

CURRENT REGULATOR, THRESHOLD VOLTAGE GENERATOR

This is a continuation of application Ser. No. 349,204, filed May 9, 1989 now abandoned.

The present application is related to integrated circuits and, more particularly, to MOS current regulator and reference voltage generator circuits.

BACKGROUND OF THE INVENTION

The present invention is an integrated circuit regulator for controlling the current in a variety of MOS circuits. One type of circuit has a cascode transistor with its source electrode coupled to one voltage supply (ground) through a network and its drain electrode connected to an undefined network. Another type of circuit has simply a transistor having its source electrode connected to ground and its drain connected to an undefined network. A third type of circuit which could benefit from the current regulator of the present invention has a transistor with a source electrode connected to a second voltage supply ($V_{cc}$) and its drain electrode connected to an undefined network.

Typically with the general cascode transistor-current source MOS circuit there are currents nearly proportional to the square of the supply voltage, $V_{cc}$. Power dissipation is thus nearly proportional to the cube of $V_{cc}$. Thus, power dissipation can be a significant problem.

Another problem for this general circuit is that the current through the circuit typically varies with processing variations. For example, if processing is "good", the particular lot of integrated circuits has transistors with more current drive. If the processing has not been good, then the current drive of the processed transistor is not as large. Typically with better processing the threshold voltage, $V_T$, of the MOS transistors in the integrated circuit falls while the $\beta=\frac{1}{2}\mu_O C_{OX}(W/L)$ of the individual transistors increases. These processing variations in the transistor device parameters result in operational currents in the general circuit and the integrated circuit containing this circuit to vary wildly depending upon the vagaries of processing.

The present invention solves or substantially mitigates these problems of the general cascode transistor-current source circuit. In one particular embodiment, the current flowing in the circuit is proportional to $V_{cc}$, not $V_{cc}^2$, and is substantially independent of processing variations.

The present invention also provides current regulation for the other two types of general circuits. Finally the present invention can act as reference voltage generator by providing for a reference voltage equal to the threshold voltage of MOS transistors, $V_T$.

SUMMARY OF THE INVENTION

The present invention provides for an MOS integrated circuit connected between a first voltage supply at $V_{cc}$ and a second voltage supply at ground. The circuit has a current-biasing network connected to ground at one end and to the source electrode of a first MOS transistor at the other end. The current by the current-biasing network appears at the drain electrode of the first transistor. By a current mirror arrangement this current is duplicated through a second transistor which is in a diode configuration. The gate electrode of the second transistor is connected to that of the first, while the second transistor's source electrode is connected to the drain electrode of the third transistor also in diode configuration. The source electrode of the third transistor is connected to ground.

By designing the device parameters of the first, second and third transistors such that $\beta_1$ is one-fourth $\beta_2$ and $\beta_2$ is equal to $\beta_3$, then the voltage at the source electrode of the first transistor is substantially the threshold voltage $V_T$ of the transistors.

If the current-biasing network comprises a fourth transistor in the linear mode, an output terminal can be connected to the gate electrode of the first transistor. By connecting this output terminal to parallel circuits in the integrated circuit which circuits have an MOS transistor connected to ground through a network, the current through each parallel current becomes regulated. By connecting the output terminal to the MOS transistor, which is operating as a cascode transistor, the current through the parallel circuit become substantially independent of processing variations. Furthermore, the current becomes proportional to $V_{cc}$, rather than $V_{cc}^2$ as is typical is such cascode transistor circuits. Thus power dissipation becomes less worrisome with a variable supply voltage.

Furthermore, by connecting output terminals to other nodes in the circuit of the present invention, current regulation can also be provided for other types of general circuits.

SPECIFIC EMBODIMENTS OF THE INVENTION

The present invention takes advantages of many of the benefits of integrated circuit technology. In an integrated circuit precise matching of specific relationships of the operational characteristics of two or more devices are possible. For example, in the present invention the threshold voltage, $V_T$, of the NMOS transistors are designed to be equal. This is also true of the device parameters, such as channel width over channel length ratios, unless stated otherwise.

Figure 1:
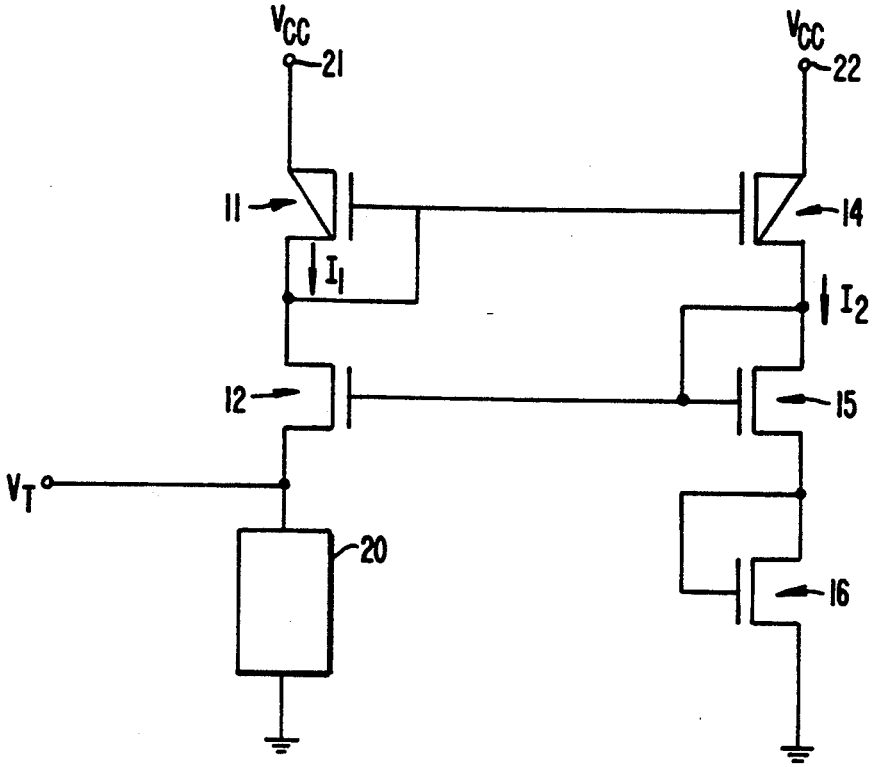
FIG. 1 is a circuit diagram of one embodiment of the present invention.

FIG. 1 shows a generalized concept of the present invention. The circuit has a current-biasing network 20 connected to ground and source electrode of an NMOS transistor 12. The drain electrode of the transistor 12 is connected to a current mirror arrangement of two PMOS transistors 11, 14. The transistor 11 has its drain electrode connected to its gate electrode, which is in turn connected to the gate electrode of the transistor 14. The source electrode of the transistor 11 is connected to a positive supply voltage at $V_{cc}$, typically +5 volts for MOS and CMOS circuits. Similarly, the source electrode of the PMOS transistor 14 is connected to the $V_{cc}$ supply voltage.

Thus whatever current $I_1$ is drawn from the drain electrode of transistor 11 is supplied by the drain electrode of the transistor 14. $I_1$ is equal to $I_2$.

The PMOS transistor 14 has its drain electrode connected to a drain electrode of an NMOS transistor 15. A source electrode of the transistor 15 is connected to the drain region of a NMOS transistor 16 having its source electrode connected to the second voltage supply at ground. Both NMOS transistors 15, 16 are connected as diodes, i.e., the gate electrode of each transistor is connected to the drain region of that transistor. Finally, the gate electrode of the transistor 15 is connected to the gate electrode of the transistor 12.

Since the current from the PMOS transistor 11 is equal to the current from the PMOS transistor 14, the drain current through transistor 12 is equal to the drain current through the transistor 15. Since both transistors are in the saturated mode, $$\beta_{12}(V_{GS12}-V_T)^2=\beta_{15}(V_{GS15}-V_T)^2$$

where $$\beta_i=\tfrac{1}{2}\mu_O C_{OX}(W_i/L_i)$$

and $V_{GSi}$=the source/gate voltage for the transistor i.

With some manipulation, $$(\beta_{15}/\beta_{12})^{\frac{1}{2}}V_{GS15}-V_{GS12}=V_T[(\beta_{15}/\beta_{12})^{\frac{1}{2}}-1]$$

By setting the dimensions of transistor 15 with those of transistor 12 so that $$\beta_{15}=4\beta_{12},$$

then $$2V_{GS15}=V_{GS12}=V_T$$

Assuming to the first order that $V_{GS16}$ is approximately equal to $V_{GS15}$, i.e., that voltage on the substrate of the integrated circuit does not substantially affect the source-gate voltages of the two transistors 15, 16, thus $$V_{GS16}+V_{GS15}-V_{GS12}=V_T$$

$$V_{20}\approx V_T$$

Thus the voltage across the current biasing network 20 is substantially $V_T$, which is determined by the particular steps used to manufacture the integrated circuit. An output terminal connected to the source electrode of the transistor 12 is thus set at threshold voltage of the NMOS transistors in the circuit. Furthermore, it should be noted that amount of current $I_1$ biased by the network was not accounted for to fix the source electrode voltage at $V_T$.

Figure 3:
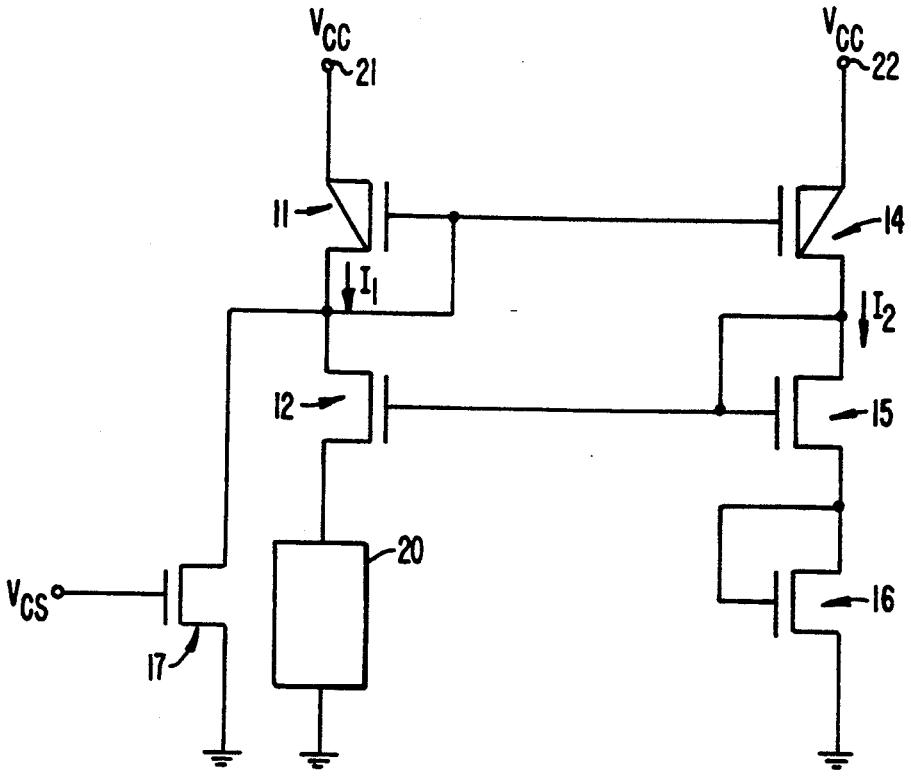
FIG. 3 is a circuit diagram of one embodiment of the present invention which avoids startup problems.

Upon the startup of the described circuit, one possible but unstable state is the non-conducting state where none of the transistors are on. To avoid this possibility, a transistor 17 having its source electrode connected to ground and its drain electrode connected to the drain electrode of the transistor 11 can be added to the circuit as shown in FIG. 3. The gate electrode of the transistor 17 is at small reference voltage $V_{CS}$ above ground so that a small current always flows through the transistor 11 to turn it on at startup. This avoids the non-conducting state.

Figure 4:
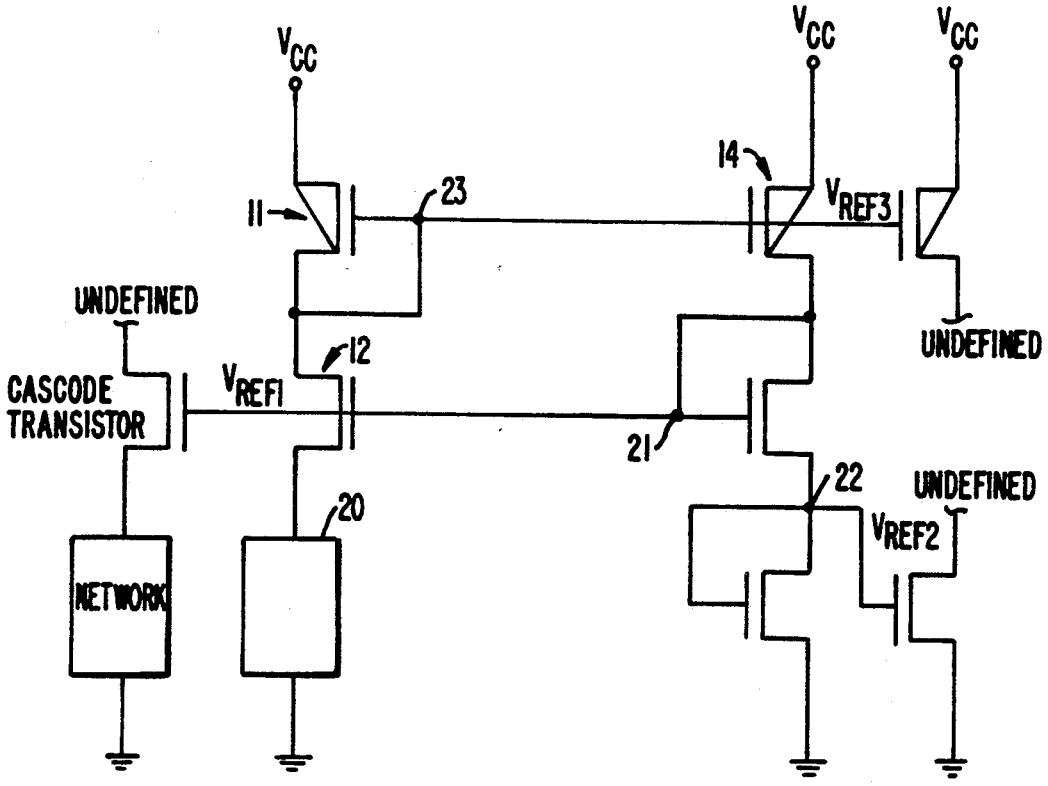
FIG. 4 is a circuit diagram of one embodiment of the present invention which illustrates the various nodes available for current regulation.

The present invention is also a current regulator. As shown in FIG. 4, various nodes in the circuit of the present invention may be used to generate reference voltages for controlling currents for different general circuits. If the node 21 is used for reference voltage $V_{REF1}$, then general circuits having a cascode transistor connected to ground through a network are suitable for current regulation. The gate electrode of the cascode transistor is connected to node 21, while the drain electrode of the transistor may be connected to an undefined network.

If node 22 is used, then a general circuit having a transistor with its source electrode connected to ground, its gate electrode connected to node 22 and its drain electrode connected to an undefined network may be current-regulated.

With node 23, a general circuit with a transistor having its source electrode connected to $V_{cc}$, its gate electrode connected to node 23 and its drain electrode connected to an undefined network is suitable.

Figure 5:
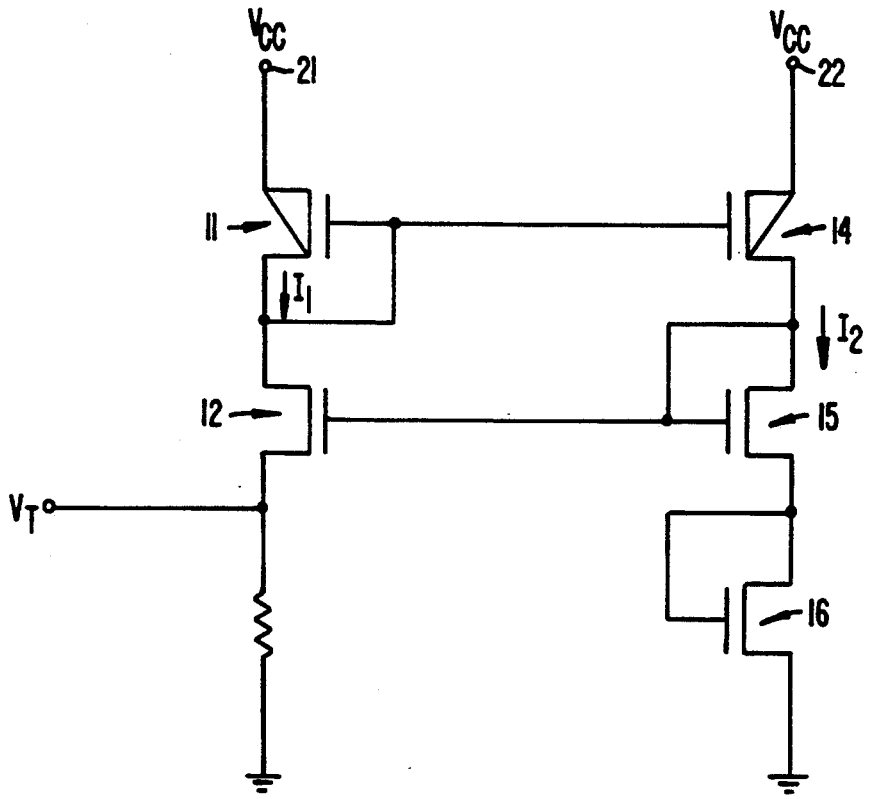
FIG. 5 is a circuit diagram of FIG. 3 with a resistor as the current biasing network.

In all three general circuits, the current is controlled by $I_1$, the current set by the current-biasing network 20. Thus the network 20 can be a simple device, such as resistor R, to set the current independent at $V_T/R$, as shown in FIG. 5.

Figure 2:
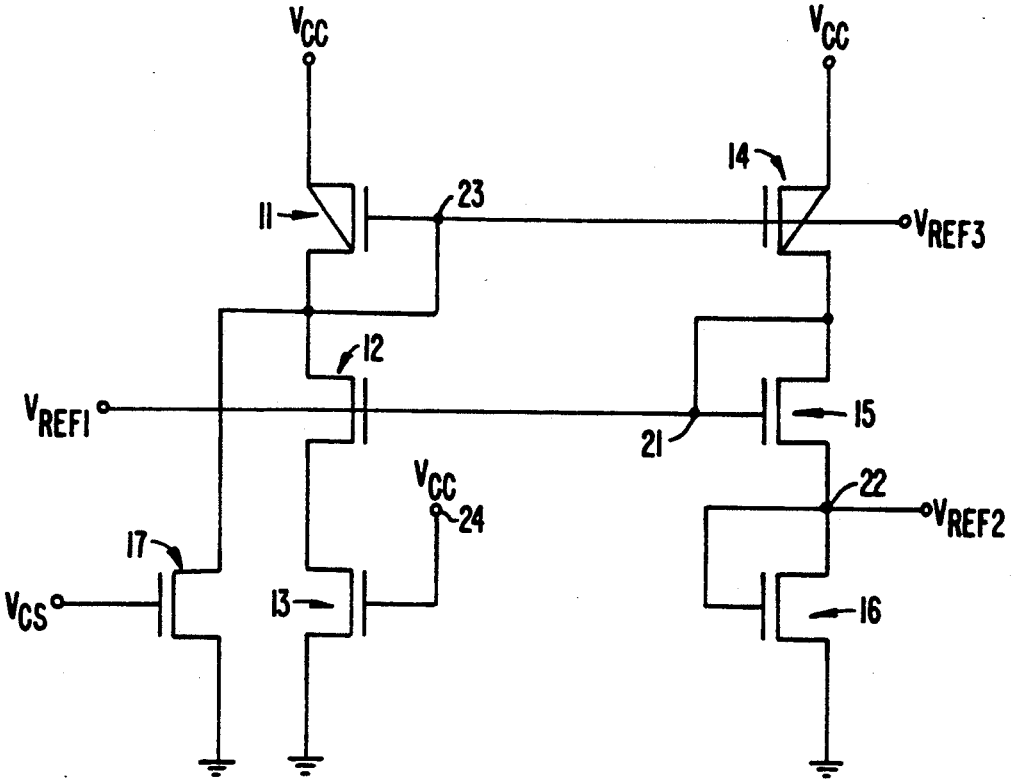
FIG. 2 is a circuit diagram of another embodiment of the present invention in which the current-biasing network is a transistor in the linear mode.

More interesting is the case where the network acts like a transistor, or transistors, operating in the linear mode. As shown in FIG. 2, the network 20 is represented by a transistor 13 connected to operate in the linear mode. Thus its gate electrode is connected to a relatively high voltage, in this case $V_{cc}$.

Since $I_1$, is equal to the current through the transistor 13, which is in the linear mode, $$\begin{aligned} I_1 &= \beta_{13}[2(V_{GS13}-V_T)V_T-V_T^2] \\ &= 2\beta_{13}V_{GS13}V_T-3\beta_{13}V_T^2 \end{aligned}$$

Therefore, $I_1$ is proportional to $$\beta_{13}V_TV_{GS13}$$

Thus the current flowing through the transistor 12 is proportional to the source-gate voltage of the transistor 13, which is $V_{CC}$. As noted previously, in most D.C. circuits the current is nearly proportional to $V_{cc}^2$. Also, the major processing terms $\beta_{13}$ and $V_T$ tend to cancel changes in each other as processing variations become extreme. The present invention consumes much less power.

Thus if the node 21 at $V_{REF1}$ is connected to the gate electrode of a cascode transistor which has its source electrode coupled to ground through a current supply as shown in FIG. 4, the present invention can regulate the current through the cascode transistor to reduce power and avoid the vagaries of semiconductor processing.

This type of connection is particularly useful where the network 20 mimicks the network connected to the source electrode of the cascode transistor. Thus the current through the cascode transistor tracks the desired range of currents suitable for the network connected to the drain electrode of the cascode transistor. Yet power consumption is restrained and the effects of processing variations are reduced.

One example of such an application of the present invention may be useful is found in a U.S. patent application U.S. Ser. No. 349,564 entitled "High Speed Differential Current Sense Amplifier," has been filed by the assignee and on the same date as the present invention. The inventors named on that application are William C.

Plants and Scott Fritz. The patent application is incorporated herein by reference. If the network 20 is designed to duplicate the bit line network including one of the static RAM cell current sources which are selectively coupled to the bit lines described in the patent application, then the advantages above may be achieved in the circuit described in the incorporated reference.

While the description above provides a full and complete disclosure of the preferred embodiments of the present invention, various modifications, alternate constructions and equivalents may be employed without departing from the true scope and spirit of the invention. For example, the circuits of the inventions may be designed in standard BICMOS technology, rather than CMOS. Therefore, the present invention should be limited only by the metes and bounds of the appended claims.

What is claimed is:

1. An MOS integrated circuit for generating a reference voltage between a first supply voltage and a second supply voltage, comprising first, second and third transistors connected in series between said first supply voltage said second supply voltage, said first transistor having a first source/drain electrode of said first transistor coupled to said first supply voltage and having a gate electrode connected to a second source/drain electrode, said third transistor having a first source/drain electrode coupled to said second supply voltage and having a gate electrode coupled to a predetermined voltage such that said third transistor operates in the linear region;

fourth, fifth and sixth transistors connected in series between said first supply voltage and said second supply voltage, said fourth transistor having a first source/drain electrode coupled to said first supply voltage and a gate electrode connected to said first transistor gate electrode, said sixth transistor having a first source/drain electrode coupled to said second supply voltage and a gate electrode connected to a second source/drain electrode, said fifth transistor having a gate electrode connected to said second transistor gate electrode and to said second source/drain electrode of said fourth transistor;

an output terminal connected to said fifth transistor gate electrode;

whereby said output terminal provides a reference voltage such that a cascode transistor having a gate electrode connected to said output terminal and having a source/drain electrode coupled to said second supply voltage, has a current therethrough relatively independent of processing variations.

2. The MOS integrated circuit as in claim 1 wherein said predetermined voltage is substantially said first supply voltage.

3. The MOS integrated circuit as in claim 2 wherein said first and fourth transistors are a first polarity type and said second, third, fifth and sixth transistors are a second polarity type.

4. The MOS integrated circuit as in claim 3 wherein said first polarity type is PMOS and said second polarity type is NMOS.

5. The MOS integrated circuit as in claim 4 wherein the device parameters of said first and fourth transistors are predetermined such that the current through said first transistor is substantially equal to the current through said fourth transistor.

6. The MOS integrated circuit as in claim 5 wherein the device parameters of said second and fifth transistors are approximately equal so that $V_T$, the threshold voltage, of both transistors are substantially equal.

7. The MOS integrated circuit as in claim 6 wherein the channel width over channel length ratio of said fifth transistor is approximately four times the channel width over channel length ratio of said second transistor.

8. The MOS integrated circuit as in claim 7 wherein the device parameters of said fifth and sixth transistors are such that $V_{GS}$, the gate-source voltage, of said fifth and sixth transistors are substantially equal, whereby $V_{DS}$, the source-drain voltage, of said third transistor, is substantially $V_T$.

9. An MOS integrated circuit for generating a reference voltage between a first supply voltage and a second supply voltage, comprising first, second and third transistors connected in series between said first supply voltage said second supply voltage, said first transistor having a first source/drain electrode of said first transistor coupled to said first supply voltage and having a gate electrode connected to a second source/drain electrode, said third transistor having a first source/drain electrode coupled to said second supply voltage and having a gate electrode coupled to a predetermined voltage such that said third transistor operates in the linear region;

fourth, fifth and sixth transistors connected in series between said first supply voltage and said second supply voltage, said fourth transistor having a first source/drain electrode coupled to said first supply voltage and a gate electrode connected to said first transistor gate electrode, said sixth transistor having a first source/drain electrode coupled to said second supply voltage and a gate electrode connected to a second source/drain electrode, said fifth transistor having a gate electrode connected to said second transistor gate electrode and to said second source/drain electrode of said fourth transistor;

a first output node at second source/drain electrode of said sixth transistor, a second output node at said gate electrode of said fourth transistor, and a third output node connected to said gate electrode of said second transistor; and a parallel circuit connected between first supply voltage and said second supply voltage, said parallel circuit having a transistor connected in parallel to one of said sixth, fourth and second transistors and having a gate electrode connected respectively to one of first, second and third output nodes;

whereby a current through said parallel circuit is relatively independent of processing variations.

10. The MOS integrated circuit as in claim 9 wherein the device parameters of said first and fourth transistors are predetermined such that the current through said first transistor is substantially equal to the current through said fourth transistor.

11. The MOS integrated circuit as in claim 9 wherein said predetermined voltage is substantially said first supply voltage.

12. The MOS integrated circuit as in claim 11 wherein said parallel circuit has a first network, and said parallel circuit transistor has first and second source/drain electrodes, said first source/drain electrode of said parallel circuit transistor connected to second supply voltage through said first network and said second source/drain electrode of said parallel circuit transistor connected to the rest of said parallel circuit.

13. The MOS integrated circuit as in claim 11 wherein said parallel circuit transistor has first and second source/drain electrodes, said first source/drain electrode of said parallel circuit transistor connected to said second supply voltage and said second source/drain electrode of said parallel circuit transistor connected to the rest of said parallel circuit.

14. The MOS integrated circuit as in claim 11 wherein said parallel circuit transistor has first and second source/drain electrodes, said first source/drain electrode of said parallel circuit transistor connected to said first supply voltage and said second source/drain electrode of said parallel circuit transistor connected to the rest of said parallel circuit.

15. The MOS integrated circuit as in claim 11 wherein said first and fourth transistors are a first polarity type and said second, third, fifth and sixth transistors are a second polarity type.

16. The MOS integrated circuit as in claim 15 wherein said first polarity type is PMOS and said second polarity type is NMOS.

17. An MOS integrated circuit connected between a first voltage supply and a second voltage supply for generating a reference voltage, comprising a first transistor having first and second source/drain electrodes and a gate electrode, said first source/drain electrode connected to said second voltage supply, said gate electrode connected to a voltage source so that said first transistor operates in the linear mode with a first current through said second source/drain electrode;

a second transistor having first and second source/drain electrodes and a gate electrode, said first source/drain electrode of said second transistor connected to said second source/drain electrode of said first transistor;

a current mirror connected to said first voltage supply having first and second electrodes, said first electrode connected to said second source/drain electrode of said second transistor, said second electrode having a second current therethrough mirroring the current through said first electrode;

a third transistor in a diode configuration, said third transistor having first and second source/drain electrodes and a gate electrode, said second source/drain electrode of said third transistor connected to said second electrode of said current mirror, said gate electrode of said third transistor connected to said gate electrode of said second transistor; and a fourth transistor in a diode configuration, said fourth transistor having a first and second source/drain electrodes, said second source/drain electrode of said fourth transistor connected to a first source/drain electrode of said third transistor, a first source/drain electrode of said fourth transistor connected to said second voltage supply; and an output terminal connected to said gate electrode of said second transistor, said output terminal connected to an electrical circuit comprising a fifth transistor having first and second source/drain electrodes and a gate electrode, said gate electrode of said fifth transistor connected to said output terminal, and a current source having first and second electrodes, said first electrode of said current source connected to said second voltage supply and said second electrode of said current source connected to said first source/drain electrode of said fifth transistor, whereby the current through said electrical circuit is substantially independent of processing variations.

18. The integrated circuit as in claim 17 wherein said current mirror comprises a sixth transistor in diode-connected configuration having first and second source/drain electrodes and a gate electrode, said first source/drain electrode of said sixth transistor connected to said first voltage supply and said second/drain electrode of said sixth transistor comprising said first current mirror electrode; and a seventh transistor having first and second source/drain electrodes and a gate electrode, said first source/drain electrode of said seventh transistor connected to said first voltage supply, said gate electrode of said seventh transistor connected to said sixth transistor gate electrode, and said second source/drain electrode of said seventh transistor comprising said second current mirror electrode.

19. The integrated circuit as in claim 18 wherein said first, second, third, fourth and fifth transistors are of one polarity type and said sixth and seventh transistors are of another polarity type.

20. The integrated circuit as in claim 19 wherein transistors of one polarity type are NMOS transistors and transistors of another polarity type are PMOS transistors.

21. The integrated circuit as in claim 17 further comprising a current source, said current source connected between said second source/drain electrode of said second transistor and said second voltage supply, whereby a non-conducting state in said integrated circuit is prevented.

* * * * *